US007891047B2

(12) United States Patent
Milanese

(10) Patent No.: US 7,891,047 B2
(45) Date of Patent: Feb. 22, 2011

(54) STEAM BROOM FOR FLOOR CLEANING

(76) Inventor: Pierantonio Milanese, C/O Euroflex SRL - Via Dei Colli 153, Susegana, TV (IT) 31058

( * ) Notice: Subject to any disclaimer, the term of this patent is extended or adjusted under 35 U.S.C. 154(b) by 834 days.

(21) Appl. No.: 11/885,994

(22) PCT Filed: Mar. 3, 2006

(86) PCT No.: PCT/IT2006/000129

§ 371 (c)(1),
(2), (4) Date: Sep. 10, 2007

(87) PCT Pub. No.: WO2006/097957

PCT Pub. Date: Sep. 21, 2006

(65) Prior Publication Data

US 2008/0189900 A1 Aug. 14, 2008

(30) Foreign Application Priority Data

Mar. 16, 2005 (IT) ..... PD2005A0078

(51) Int. Cl.
*A47L 7/00* (2006.01)
*A47L 9/02* (2006.01)

(52) U.S. Cl. ..... 15/320; 15/319; 15/322; 15/351

(58) Field of Classification Search ..... 15/319–322, 15/328, 351, 412
See application file for complete search history.

(56) References Cited

U.S. PATENT DOCUMENTS

| | | | | |
|---|---|---|---|---|
| 6,289,551 | B1 * | 9/2001 | Basile | 15/320 |
| 6,446,302 | B1 * | 9/2002 | Kasper et al. | 15/319 |
| 6,571,421 | B1 * | 6/2003 | Sham et al. | 15/320 |
| 6,584,990 | B2 * | 7/2003 | Shaw | 134/105 |
| 7,774,894 | B2 * | 8/2010 | Rippl et al. | 15/320 |

* cited by examiner

*Primary Examiner*—Dung Van Nguyen
(74) *Attorney, Agent, or Firm*—Frank Marino

(57) ABSTRACT

It is a new steam broom for floor cleaning with a boiler (C) for steam production connected to two ducts for steam delivery, the delivery duct (CF) for front jets and the delivery duct (C1) for lower jets and a detergent delivery duct (CD), the opening or closing of the valve (VU) for steam output from the boiler is controlled by the operation device (DA), connected to the arm (M1) of the handle (M), so that the rotation of said arm (M1) around the hinge (M') causes the displacement of said operating device (DA), thus causing the opening of said output valve (Vu). Said boiler (C) comprises two pressure gauges (P1) and (P2), a device for jet deflection (D) shuts one or more delivery ducts (CF), (C1) and (CD) by compressing them.

15 Claims, 3 Drawing Sheets

STEAM BROOM FOR FLOOR CLEANING

This patent concerns household appliances for floor cleaning and in particular it concerns a new steam broom for floor cleaning with adjustable steam jets underneath and/or at the front and with detergent mixing.

Several types of household appliances for floor cleaning are known, which can be used in private, public or commercial buildings.

Electric brooms and vacuum cleaners are known that, in addition to sweeping, take the impurities in, which are collected in suitable bags and then disposed of as waste.

Moreover, machines are known that clean the floors by means of spinning brushes and/or steam jets.

The large floor cleaners that are used in large places such as public or commercial buildings perform both functions of collecting waste by sweeping the floor and sucking in the waste and cleaning and washing by means of suitable brushes and jets of detergent or steam.

These appliances are extremely versatile and can guarantee excellent results in term of cleanliness but they are cumbersome and their use in homes is therefore totally unthinkable.

On the other hand, the known household appliances for floor cleaning do not often have the same versatility, thus making it necessary to use several different tools for sweeping, washing and polishing.

Moreover, most known household appliances are not user friendly because they are heavy, cumbersome and difficult and complex to use.

In order to overcome all these inconveniences a new type of steam broom for floor cleaning with adjustable steam jets underneath and at the front and with detergent mixing has been devised and constructed.

The main task of this invention is to provide deep and complete floor cleaning.

A further purpose of this invention is to clean floors by using steam and/or a detergent.

A further purpose of this invention is to be handy and easy and safe to use. These and other purposes, either direct or complementary, are achieved by the new steam broom for floor cleaning with adjustable steam jets underneath and at the front and with detergent mixing.

Said new steam broom for floor cleaning comprises among its main parts a boiler for steam production and devices for the transport and delivery of steam jets and detergent and for the control of the boiler pressure.

The new steam broom comprises a main body, which contains the boiler for steam production.

Said boiler is a metal tank comprising at least one heating element connected to a special circuit so that the connection to the mains causes the heating of said heating element and the consequent heating of the water contained in the boiler.

When the water boils, it turns into steam that will be subsequently used to clean the floors.

The boiler comprises special temperature and/or pressure gauges that guarantee its safety by enabling the opening and closing of the electric circuit powering the heating element according to the pressure reached by the steam and they therefore have the task to control and adjust, if necessary, the pressure level most suitable for the cleaning.

The boiler comprises further safety systems, i.e. valves and devices that guarantee its safe use by the user. The opening and closing of the valve responsible for steam output from the boiler is controlled by a special device, hereinafter called operating device.

Said operating device is connected to one of the arms of the lower fork of the handle of the new steam broom so that it is necessary and sufficient to operate said handle to cause the boiler to deliver the steam.

The operating device is positioned in such a way that steam delivery is allowed by simply slanting the handle from the vertical position of rest to the oblique position towards the user.

When the user slants the handle in the right direction, said device is then operated and it causes the opening of the output valve and the delivery of steam as a consequence.

The device can be for example a cam insisting on the steam output valve, which opens when the handle is moved from its vertical to its slanting position, thus causing the simultaneous displacement of said device.

The delivery of steam is interrupted when the handle is moved back to its vertical position.

In this way, the user can use the steam whenever necessary because it is always available inside the boiler, where it is kept at the ideal pressure tanks to the temperature and/or pressure gauges.

Such rotation of the handle from the vertical to the slanted position causes moreover the closing or opening of a switch that connects or disconnects the heating element to or from the power supply circuit, while bypassing the main temperature and/or pressure gauge that is set at a pre-set temperature and/or pressure value.

In this way, the heating element is immediately powered so that during the delivery of steam the entire system can keep a sufficiently high pressure so as to guarantee an excellent cleaning efficiency.

The output duct from the boiler shall then comprise a fork to allow the steam delivery from several points of the main body of the new steam broom, i.e. from one or more nozzles located in a front position for steam jet at the front, and/or one or more nozzles located in a lower position for downward steam jet, namely directly towards the floor.

The output duct from the boiler is therefore connected to at least two delivery ducts, the one taking the steam to the front nozzles and the other taking the steam to the nozzles located under the main body.

Said ducts are hereinafter called duct for steam delivery for front jets and duct for steam delivery for lower jets respectively.

A device, hereinafter called a device for jet deflection, has the function to open or close said delivery ducts to allow the steam to come out from the front and/or lower nozzles.

To this purpose, said device for jet deflection is for example a slider that, if moved from a set position to the other one, can compress the duct for steam delivery for front jets or the duct for steam delivery for lower jets, thus causing the shutting of a delivery duct and therefore interrupting the steam delivery from the nozzles linked to that specific duct.

If the user wants the steam to be delivered both from the front and from underneath the main body, the device for jet deflection is positioned so as to shut neither of the two ducts for steam delivery for front jets and for lower jets.

The new steam broom comprises a further delivery duct, hereinafter called detergent delivery duct, which is connected to a special cup containing the floor detergent and located in a suitable position inside the main body.

Moreover, the device for jet deflection can be positioned so as to shut only the duct for detergent delivery, in case the user does not want to use the detergent but only steam.

To this purpose, the delivery ducts are made of a silicone hose and are deformable so that they can be easily compressed by the action of said device for jet deflection and can then go back to their initial shape.

The duct for detergent delivery is provided with a fork that connects it both to the duct for steam delivery for front jets and to the duct for steam delivery for lower jets.

The link between the duct for detergent delivery and each of the two ducts for steam deliver is obtained by means of a Venturi tube, i.e. a reduction of the section of the duct for steam delivery for the jets and when the steam meets such reduction, its speed increases, thus causing a depression in the duct for detergent delivery.

In this way, the detergent is sucked into said duct for steam delivery so that it can come out of the front and/or lower nozzles already mixed with the steam.

As an alternative, to deliver the detergent it is possible to foresee the use of a pump that takes the detergent from the cup and sends it into the ducts for steam delivery.

The characteristics of the new steam broom for floor cleaning will be better explained in the following description with reference to the drawings that are enclosed as non-restrictive examples.

Figure 1:
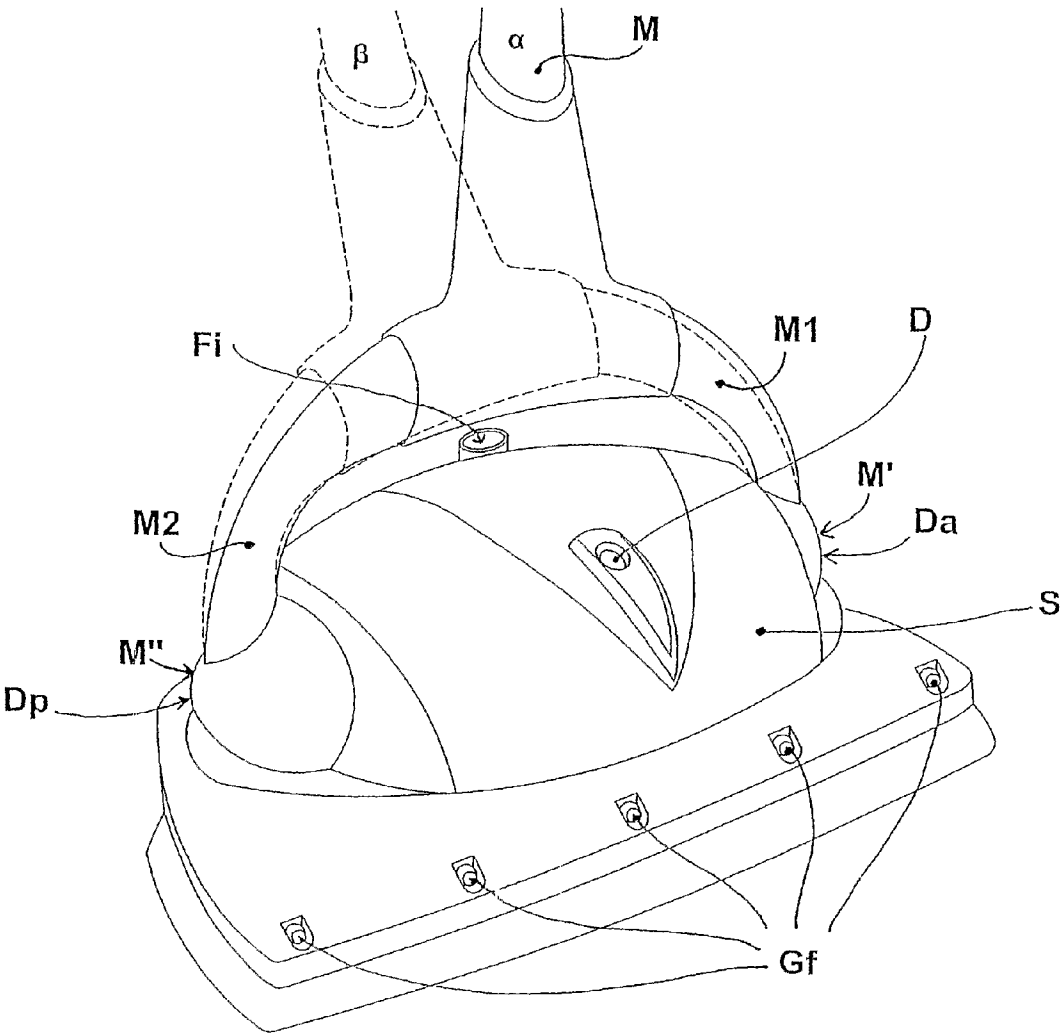
FIG. 1 shows an overall view of the invention.
Figure 2:
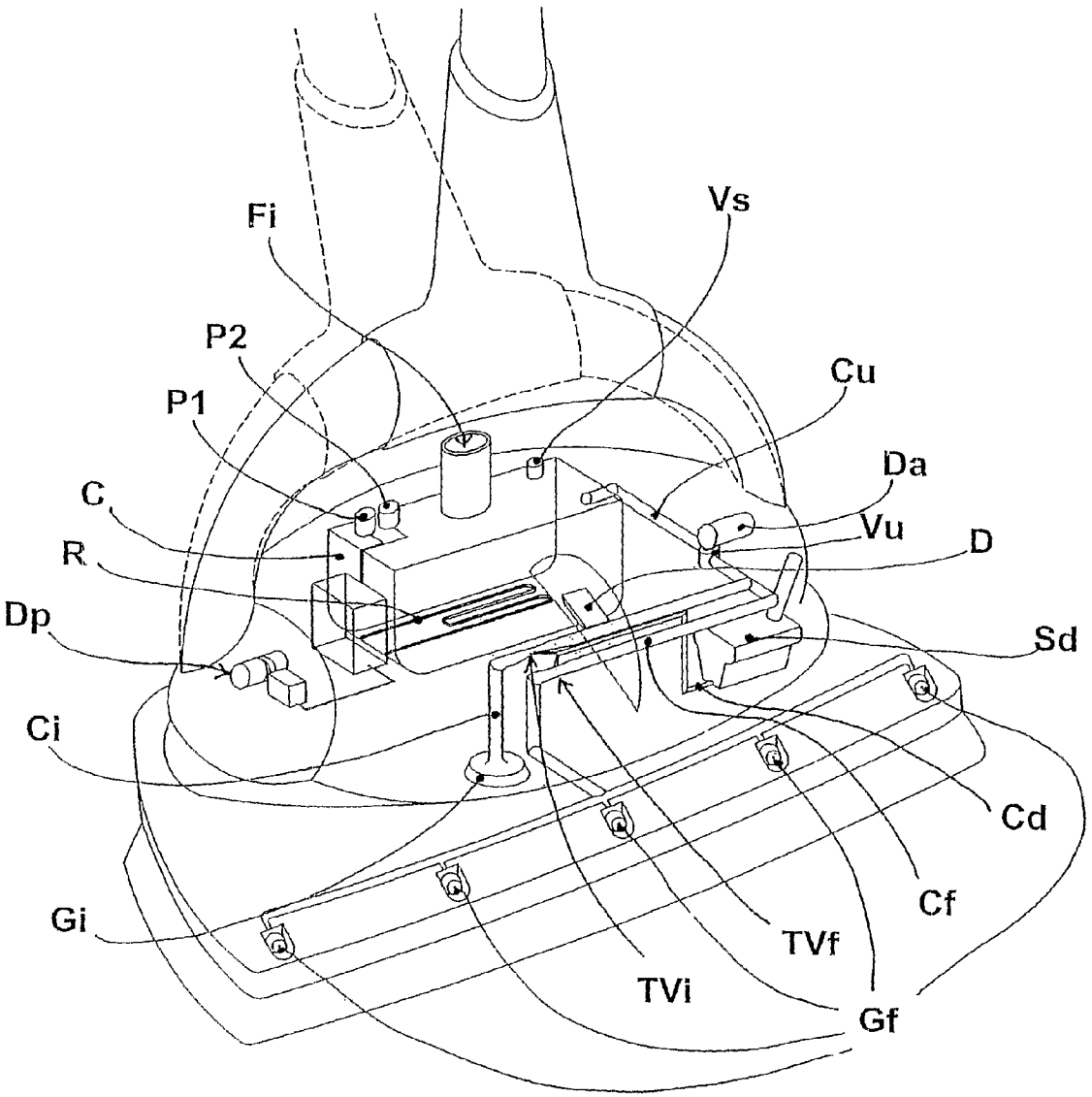
FIG. 2 shows a section plane of the new steam broom, where it is possible to see the delivery ducts, the arrangement and functioning of the jet and pressure operating and controlling devices.

The main body (S) is connected to the handle (M) by means of a fork with two arms (M1) and (M2) that are hinged on the main body (S) by means of special hinges (M') and (M").

Said main body (S) comprises nozzles (Gf) and (Gi) located in the front part, the tip, and in the lower part respectively.

The main body (S) contains the boiler (C), which comprises an input hole (Fi) for feeding water and an output hole linked to an output duct (Cu).

Said boiler (C) hosts a heating element (R) inside and when appropriately connected to the mains through a normal circuit, it begins to function, thus heating said heating element (R).

A primary temperature gauge (P1) and/or a pressure gauge located inside the boiler (C) and connected to the circuit for power supply to the heating element (R) has the task to check the pressure level of the steam produced and contained inside the boiler, thus causing the opening of the electric circuit whenever the temperature and/or the pressure reach the limit value at which P1 is set.

The safety valve (Vs) provides for the safe use by the user by allowing the steam delivery in case that the pressure inside the boiler reaches dangerously high values.

Said output duct (Cu) is shut by an output valve (Vu), which is opened by a specific operating device (Da).

Said operating device (Da) is connected to arm (M1) of the handle (M), so that the rotation of said arm (M1) around the hinge (M') causes the displacement of said operating device (Da), thus causing the opening of the output valve (Vu).

Practically, when the handle (M) is in position a, i.e. in a vertical position, the output valve (Vu) is closed, while when the handle (M) is moved to position β, the output valve (Vu) is open and the steam can be delivered.

The boiler (C) comprises a further temperature gauge and/or a pressure gauge, hereinafter called secondary gauge (P2), which is set at a temperature and/or pressure value that is higher than the temperature and/or pressure value P1.

A switch (Dp) connects the mains to the heating element (R) while bypassing the primary gauge (P1), so that the circuit can be immediately closed as soon as arm (M1) or (M2) of the handle (M) is moved to a slanted position, i.e. to position β.

Said switch (Dp) is linked to arm (M2) of the handle (M), so that the rotation of said arm (M2) around the hinge (M") causes the opening and closing of the same switch (Dp), thus allowing the connection of the heating element (R) to the electric circuit powering the same heating element (R). Therefore, thanks to this switch (Dp), when the user moves the handle (M) from the vertical position α to the slanted position β to start the steam delivery, the pressure of said steam will be kept sufficiently high so as to guarantee excellent cleaning efficiency.

The output duct (Cu) is connected to at least two steam delivery ducts: the duct for steam delivery (Cf) for front jets and the duct for steam delivery (Ci) for lower jets, which take the steam and the detergent if it is the case up to the front nozzles (Gf) and to the lower nozzles (Gi).

The duct for detergent delivery (Cd) connects the cup (Sd), which is the detergent tank, to both ducts for steam delivery (Cf) and (Ci) for front and lower jets.

The connection between the duct for detergent delivery (Cd) and each of the two ducts for steam delivery (Cf) and (Ci) for the jets is obtained by means of Ventuli tubes, i.e. reductions (TVf) and (TVi) of the sections of the ducts for steam delivery (Cf) and (Ci) for the jets.

When the steam reaches said reductions of the sections (TVf) and (TVi), its speed increases, thus producing a depression in the duct for detergent delivery (Cd).

In this way, the detergent is sucked into one of or both said ducts for steam delivery (Cf) and (Ci) for the jets and it comes out from the front nozzles (Gf) and/or lower nozzles (Gi) already mixed with the steam.

Figure 3:
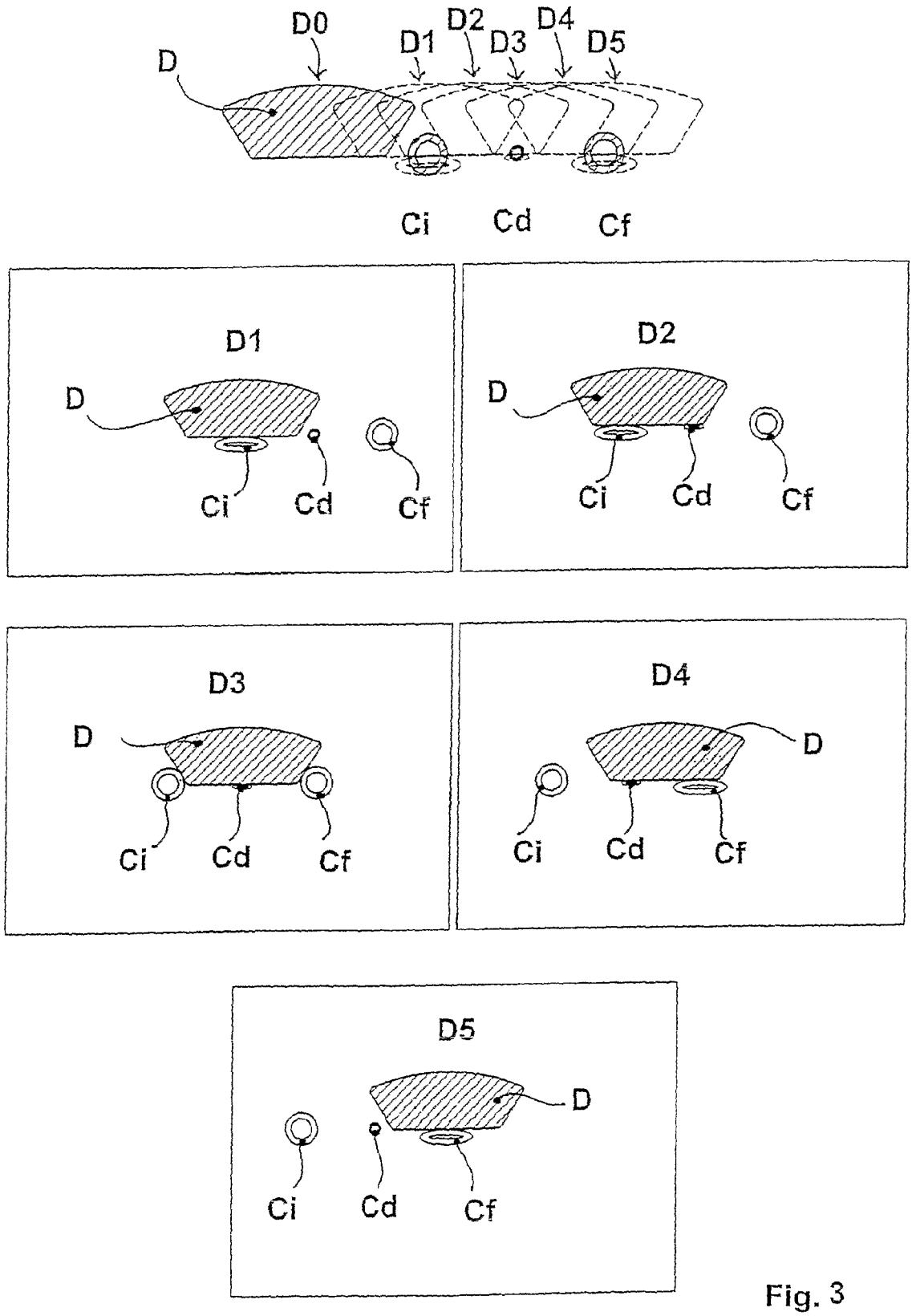
FIG. 3 shows detailed schemes of the different possibilities of steam and detergent delivery by changing the position of the device for jet deflection.

The device for jet deflection (D) is a slider that can be moved from one set position to the other, as shown in FIG. 3, in order to prevent/allow the delivery of steam from the front nozzles (Gf) and/or the lower nozzles (Gi). When said device for jet deflection (D) is positioned in D0, it does not shut any delivery duct (Cf), (Ci) or (Cd).

If it is positioned in D1, D3 or D5, only the duct for steam delivery (Ci) for lower jets or only the duct for detergent delivery (Cd) or only the duct for steam delivery (Cf) for front jets is shut respectively.

The intermediate positions D2 and D4 allow shutting the duct for detergent delivery (Cd) at the same time as the duct for steam delivery (Ci) for lower jets or the duct for steam delivery (Cf) for front jets respectively.

Shutting one or more delivery ducts entails the interruption of steam and/or detergent delivery from the nozzles linked to those specific ducts.

This is a brief explanation that is sufficient for an expert to make up the invention and, as a consequence, when practically doing it, changes can be made without prejudice of the substance of the innovative idea.

Therefore, with reference to the description hereinbefore and the enclosed figures the following claims are stated.

The invention claimed is:

1. A steam broom for floor cleaning comprising:

a main body comprising a boiler, said boiler comprising:

a heating element;

a safety valve;

a primary gauge comprising one or both of a first temperature and a first pressure gauge;

an inlet hole for feeding water;

an outlet hole;

an outlet duct positioned adjacent said outlet hole; and an output valve adapted for selectively shutting said outlet duct;

a handle linked to the main body by means of a fork having first and second arms, said handle attached to the fork by first and second hinges;

an operating device linked to the first arm so that rotation of said first arm around the first hinge causes displacement of said operating device, thus opening or shutting said output valve;

first nozzles and second nozzles for steam delivery inserted in the main body.

2. The steam broom of claim 1, wherein said first nozzles are located forwardly on said main body.

3. The steam broom of claim 2, wherein said second nozzles are located underneath said main body.

4. The steam broom of claim 3, wherein said output duct is connected to first and second steam delivery ducts, wherein the first steam delivery duct provides steam to the first nozzles, and the second steam delivery duct provides steam to the second nozzles.

5. The steam broom of claim 4, wherein said boiler comprises a switch having closed and open states which are determined by rotation of the second arm around the second hinge, thus allowing connection/disconnection of said heating element with an electric power supply circuit, while bypassing said primary gauge to prevent the electrical power supply circuit from causing a first temperature and/or a first pressure in excess of a first temperature and/or first pressure value set at said primary gauge.

6. The steam broom of claim 5, wherein said boiler further comprises a secondary gauge comprising one or both of a second temperature and a second pressure gauge set at a second temperature and/or second pressure limit value higher than the first temperature and/or first pressure value of said primary gauge.

7. The steam broom of claim 6, further comprising a reservoir containing detergent and a detergent delivery duct, which connects said reservoir to one or both of said first and second steam delivery ducts, wherein through a Venturi effect the detergent is sucked into said one or both of said first and second steam delivery ducts and is mixed with steam and dispensed.

8. The steam broom of claim 7, further comprising a slider suitable for opening or shutting one or more of said steam and detergent delivery ducts.

9. The steam broom of claim 8, wherein said slider cannot shut any of said steam and detergent delivery ducts during a starting position.

10. The steam broom of claim 9, wherein said slider has a first position in which it only shuts said second steam delivery duct.

11. The steam broom of claim 10, wherein said slider further has a second position in which it shuts said second steam delivery duct and said detergent delivery duct.

12. The steam broom of claim 11, wherein said slider further has a third position in which it only shuts said detergent delivery duct.

13. The steam broom of claim 12, wherein said slider further has a fourth position in which it shuts said first steam delivery duct and said detergent delivery duct.

14. The steam broom of claim 13, wherein said slider further has a fifth position in which it only shuts said first steam delivery duct.

15. The steam broom of claim 14, wherein said steam delivery and detergent ducts are made of flexible silicone.

* * * * *